United States Patent [19]

Barrus et al.

[11] Patent Number: 4,749,294

[45] Date of Patent: Jun. 7, 1988

[54] PRINTER HAMMERBANK CAM DRIVE HAVING PULSED STARTUP

[75] Inventors: Gordon B. Barrus, San Juan Capistrano; Peter D. Andriola, Garden Grove, both of Calif.

[73] Assignee: Printronix, Inc., Irvine, Calif.

[21] Appl. No.: 68,346

[22] Filed: Jul. 1, 1987

[51] Int. Cl.[4] ..... B41J 19/30

[52] U.S. Cl. ..... 400/322; 400/121; 400/323; 101/93.04; 318/254

[58] Field of Search ..... 400/121, 124, 320, 322, 400/328, 323; 101/93.04, 93.05; 318/101, 138, 254, 301, 326, 329, 578

[56] References Cited

U.S. PATENT DOCUMENTS

| | | | |
|---|---|---|---|
| 3,743,902 | 7/1973 | Perkins, III et al. | 318/326 |
| 3,941,051 | 3/1976 | Barnes et al. | 400/121 |
| 4,227,455 | 10/1980 | Pennebaker | 400/124 |
| 4,239,403 | 12/1980 | Matula et al. | 400/322 |
| 4,563,620 | 1/1986 | Komatsu | 318/254 |

FOREIGN PATENT DOCUMENTS

| | | | |
|---|---|---|---|
| 176063 | 10/1984 | Japan | 400/121 |

*Primary Examiner*—David Wiecking

*Attorney, Agent, or Firm*—Bogucki, Scherlacher, Mok & Roth

[57] ABSTRACT

In a dot matrix line printer in which an elongated hammerbank and an opposite conunterbalancing assembly are driven in opposing reciprocating fashion by a motor driven cam, the size of the cam drive motor and the current requirements thereof during startup of the printer are greatly reduced by applying current pulses to the motor in a pattern synchronous with the resonant frequency of the reciprocating cam driven system. The current pulses which are considerably smaller in amplitude than the continuous current conventionally used to produce startup are generated during alternate half cycles of the resonant frequency, causing the cam to rock back and forth until eventually the peak resistance presented by opposite lobes on the cam and the consequent maximum compression of springs within the cam followers coupling the cam to the hammerbank and the counterbalancing assembly is overcome. Thereafter, a continuous current of appropriate value is applied to the cam drive motor to produce reciprocation of the hammerbank at a desired steady state speed.

10 Claims, 5 Drawing Sheets

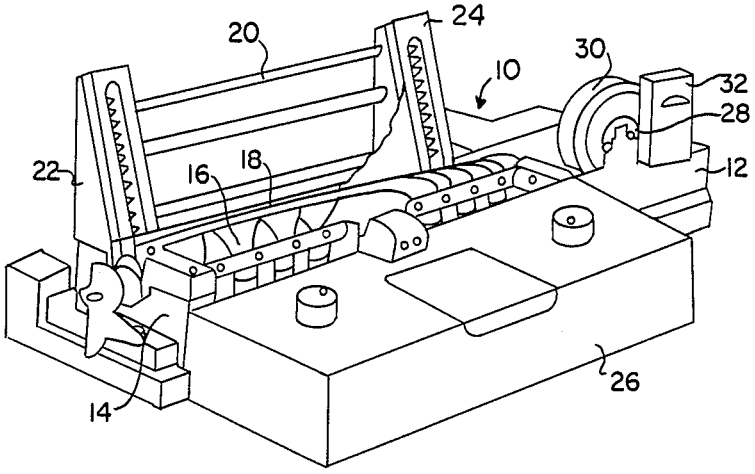
FIG. 1
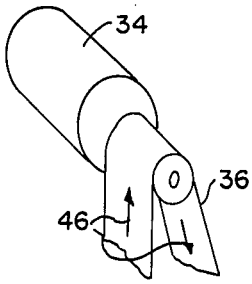
FIG. 2
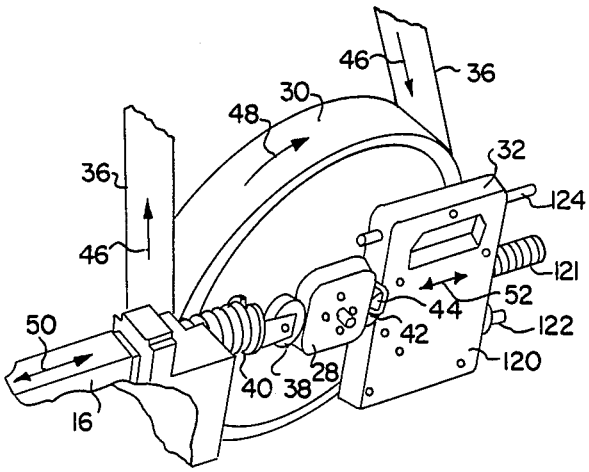

PRINTER HAMMERBANK CAM DRIVE HAVING PULSED STARTUP

BACKGROUND OF THE INVENTION

1. Field of the Invention.

The present invention relates to printers, and more particularly to printers in which a hammerbank or other elongated printing member is driven in reciprocating fashion by a rotating cam.

2. History of the Prior Art.

It is known in the printer arts to provide a reciprocating elongated printing member such as a hammerbank adjacent a length of print paper to accomplish printing. An example of such a printer is provided by U.S. Pat. No. 3,941,051 of Barrus et al., PRINTER SYSTEM, issued Mar. 2, 1976 and commonly assigned with the present application. In the printer described in the Barrus et al. patent, an elongated hammerbank is driven in reciprocating fashion across the width of a print paper supported by an elongated platen. As the hammerbank undergoes its back and forth reciprocating movement across the print paper, magnetic hammer acutators mounted along the length of the hammerbank are selectively actuated to release or 'fire' hammer springs associated therewith. This causes dot printing impact tips mounted on the fired hammer springs to impact the print paper through a length of ink ribbon to print dots on the paper. A counterbalancing assembly is driven in reciprocating fashion in an opposite, out-of-phase relationship with the hammerbank to minimize the vibrational motion that would otherwise result from the reciprocation of the hammerbank.

In the printer system described in U.S. Pat. No. 3,941,051 of Barrus et al., the elongated hammerbank and the counterbalancing assembly are driven in opposing reciprocating fashion by a single cam which engages opposite cam follower assemblies coupled to the hammerbank and to the counterbalancing assembly. The cam, which is configured to have opposite lobes thereon, is rotatably driven through a coupled flywheel by a drive motor. As the cam rotates, repeated movements of the lobes thereon past the cam follower assemblies produces reciprocating motion of the hammerbank and the counterbalancing assembly. The cam follower assemblies which couple the hammerbank and the counterbalancing assembly to the cam have compression springs which force and maintain cam follower pulleys at the ends of the cam follower assemblies in contact with the cam.

During startup of printers such as of the type described in the Barrus et al. patent having a cam driven hammerbank and counterbalancing assembly, considerable torque is required to move the cam past the point of peak resistance which is where the peaks of the opposite lobes engage the opposite cam follower pulleys and provide maximum compression of the springs within the cam follower assemblies. The startup torque requirements are such that the current required to produce the torque is typically as much as ten times greater than the current required to maintain steady state operation thereafter in which the hammerbank and the counterbalancing assembly are driven at a chosen constant speed. In many cases, a larger cam drive motor than that which would be required to maintain steady state operation, is required because of the high starting torque which must be produced to overcome initial cam resistance. This is disadvantageous, both from the standpoint of increased motor size and cost and from the standpoint of high current requirements and the power supplies needed to produce such currents.

Accordingly, it would be advantageous to provide an improved printer cam drive arrangement. It would be particularly advantageous to provide such an arrangement in which startup can be accomplished without the large motor currents normally required and without the need for the larger and more expensive motors often needed to meet the startup requirements.

BRIEF SUMMARY OF THE INVENTION

The foregoing and other objects and features in accordance with the invention are accomplished by providing an improved cam drive arrangement for driving a hammerbank and a counterbalancing assembly.

Cam drive arrangements in accordance with the invention accomplish startup by intermittently applying power to the cam drive motor in a pattern which is synchronous with the resonant frequency response of the reciprocating cam driven system comprised of the hammerbank and the counterbalancing assembly and the cam follower assemblies therefor. Current pulses are applied to the motor at a rate determined by the resonant frequency so that the current pulses occur during alternative half cycles. Each current pulse is approximately equal in duration to the period of the first half cycle of the resonant frequency response.

Each current pulse produces rotation of the cam in a driven direction, accumulating energy in the springs of the cam follower assemblies that couple the cam to the hammerbank and the counterbalancing assembly. Following termination of the current pulse, the cam rocks back in a direction opposite the driven direction. As the cam again reverses in direction, the next current pulse commences in order to reinforce the motion in the driven direction and amplify the oscillations. The sequence is repeated until the point of peak resistance to rotation of the cam which is where the peaks of the opposite lobes on the cam engage the pulleys of the opposite cam followers is passed. When this occurs a continuous current is then applied to the cam drive motor to sustain steady state movement of the system at the desired speed.

The current pulses applied to the cam drive motor during startup are preferably of like duration and are generally equally spaced from each other so that each current pulse commences at a point in time corresponding to the beginning of a different cycle of the resonant frequency response of the reciprocating cam driven system. As previously noted, each current pulse is approximately equal to the duration of the first half cycle of the series of cycles defined by the resonant frequency response of the cam driven system.

The number of current pulses required to overcome the peak resistance to rotation of the cam can be determined initially so that feedback sensing of the system is not necessary. Instead, the motor is simply pulsed the required number of times for a given current pulse amplitude and duration to rotate the peaks of the opposite lobes on the cam past the opposite cam follower assemblies and thereby accomplish startup. Following that a continuous current of amplitude which will drive the system at the desired speed in steady state fashion is applied. Although the amplitude of the startup current pulses is greater than the amplitude of the continuous current required to produce steady state operation, the amplitude of the startup current pulses nevertheless is considerably smaller than the current amplitude required to accomplish startup under the conventional technique of applying a continuous current to the cam drive motor. Alternatively, a closed loop system can be used in which the positioning of the cam is determined using the position feedback signals for the cam drive system and the motor is pulsed in accordance with the actual information of cam position.

The amplitude of the startup current pulses varies inversely with the number of pulses to be used to achieve startup. Thus, a current pulse amplitude slightly greater than that required to sustain steady state operation will achieve startup if a large number of pulses of that amplitude are applied. Conversely, a few current pulses will achieve startup if the amplitude of such pulses is great enough.

In a preferred cam drive arrangement according to the invention, the cam drive motor is a servo controlled brushless DC motor. The servo system for controlling the motor produces a signal representing the actual speed of the motor and compares it with a command signal representing desired motor speed. Any difference in the signals produces an error signal which is applied to the motor to adjust the speed thereof accordingly. The command signal is produced by a control computer. The resonant frequency response of the reciprocating cam driven system comprised of the hammerbank, the counterbalancing assembly and the cam follower assemblies which couple the hammerbank and the counterbalancing assembly to the cam is determined by rotating the cam until the peaks of opposite lobes thereon engage the pulleys of the opposite cam follower assemblies. The cam is then released and the motion thereof as a function of time is then detected and plotted as the cam eventually settles to rest. While the individual periods of the resulting resonant response of the cam driven system vary somewhat due to spring rate variations in the cam follower assemblies, an average of the resonant frequency response and the periods of the cycles and half cycles thereof can be determined.

Upon startup, the control computer produces command signal pulses in synchronism with the average resonant frequency so that each pulse is initiated at the beginning of a cycle of the resonant frequency and terminates midway through the cycle. The amplitude of the command signal pulses is chosen to produce current pulses of desired amplitude at the motor. Once the command signal pulse amplitude is determined, the number of command signal pulses needed to achieve startup is next determined. This can be calculated or it can be arrived at experimentally by actually pulsing the motor and observing how many pulses are required to overcome the peak resistance. The control computer is then programmed to produce the required number of command signal pulses of that amplitude at each startup before producing a continuous command signal which will generate a continuous motor current of necessary amplitude to sustain steady state reciprocation of the cam driven system at a desired speed.

BRIEF DESCRIPTION OF THE DRAWINGS

A better understanding of the invention may be had by reference to the following description, taken in conjunction with the accompanying drawings, in which:

FIG. 1 is a perspective view of a dot matrix line printer having an improved cam drive assembly in accordance with the invention;

FIG. 2 is a perspective view of the cam drive assembly of the printer of FIG. 1;

DETAILED DESCRIPTION

FIG. 1 depicts a printer 10 having a cam drive assembly 12 in accordance with the invention. The printer 10 which is a dot matrix line printer is of the general type described in the previously referred to U.S. Pat. No. 3,941,051 of Barrus et al. The particular example of the printer 10 shown and described in FIG. 1 and hereafter is described in greater detail in a copending application Ser. No. 069,486 of Norman E. Farb, "PRINTER HAVING INTERCHANGEABLE SHUTTLE ASSEMBLY", which application was filed on July 1, 1987 and is commonly assigned with the present application, as well as in a copending application Ser. No. 069,021 of Norman E. Farb, "PRINTER HAVING IMPROVED HAMMERBANK", which application was filed on July 1, 1987 and is also commonly assigned with the present application. Accordingly, the portions of the printer 10 other than the cam drive assembly 12 are only briefly described herein.

Figure 3:
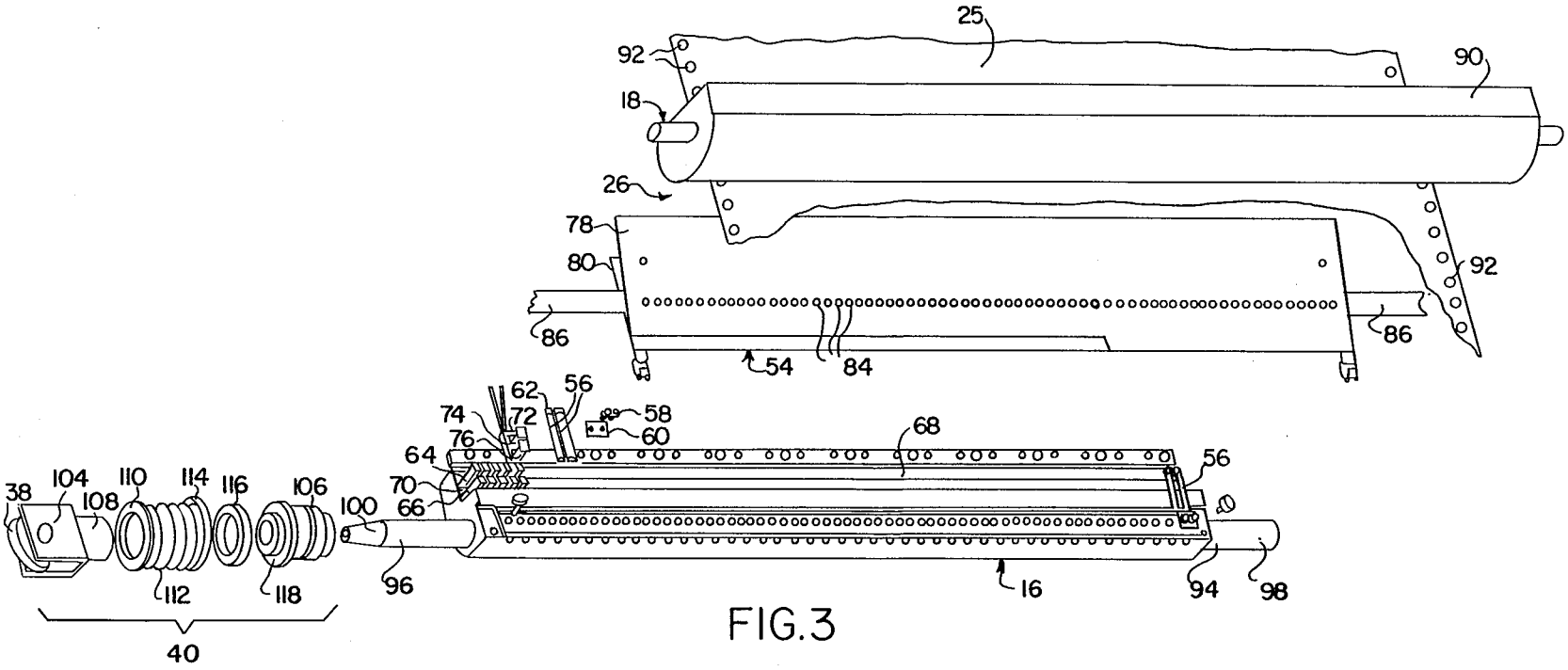
FIG. 3 is an exploded perspective view of the hammerbank and the platen assembly of the printer of FIG. 1 and showing the cam follower assembly of the hammerbank.

The printer 10 includes a shuttle assembly 14 having an elongated hammerbank 16 and a platen assembly 18 which are described in greater detail hereafter in connection with FIG. 3. A tractor drive assembly 20 mounted next to the platen assembly 18 has opposite tractor drives 22 and 24 for engaging perforations at the opposite edges of a length of print paper 25. The tractor drives 22 and 24 advance the length of print paper 25 upwardly in incremental fashion through a print station 26 defined by the interface between the hammerbank 16 and the platen assembly 18. A ribbon deck 27 disposes a length of ink ribbon in the print station 26 between the hammerbank 16 and the platen assembly 18 as described hereafter in connection with FIG. 3.

Printing within the printer 10 of FIG. 1 is accomplished by releasing or "firing" selected ones of a plurality of hammer springs mounted along the length of the hammerbank 16 as described hereafter in connection with FIG. 3. The hammer springs have dot printing impact tips mounted thereon which impact the length of ink ribbon from the ribbon deck 27 against the length of print paper 25 to print dots as the hammerbank 16 is reciprocated back and forth across the length of print paper 25 held by the tractor drives 22 and 24 and supported against the platen assembly 18. The hammerbank 16 is driven in reciprocating fashion by a cam 28 mounted on a flywheel 30 within the cam drive assembly 12. The cam 28 also engages a counterbalancing assembly 32 and drives the counterbalancing assembly 32 in an opposite, out-of-phase manner from the hammerbank 16. In this way, the counterbalancing assembly 32 counterbalances the hammerbank 16 so as to minimize the vibratory motion which would otherwise result within the printer 10.

The cam drive assembly 12 is shown in detail in FIG. 2, and includes a cam drive motor 34 coupled via a drive belt 36 to rotatably drive the flywheel 30 to which the cam 28 is coupled. The cam 28, which in the present example has four different lobes thereon arranged into two different opposite pairs of lobes as described hereafter in connection with FIGS. 4A and 4B, engages a pulley 38 of a cam follower assembly 40 coupled to the hammerbank 16. The cam 28 also engages a pulley 42 of a cam follower assembly 44 coupled to the counterbalancing assembly 32.

The cam drive motor 34 is normally driven in a clockwise direction as viewed in FIG. 2 so as to move the drive belt 36 in a direction shown by arrows 46. This produces clockwise rotation of the flywheel 30 as shown by an arrow 48 and clockwise rotation of the cam 28 which is coupled to the flywheel 30. As the cam 28 rotates in the clockwise direction, the passing of the various lobes of the cam 28 over the cam follower pulley 38 produces back-and-forth reciprocating motion of the hammerbank 16 as represented by an arrow 50. In like fashion, passage of the lobes of the cam 28 over the cam follower pulley 42 produces reciprocating motion of the counterbalancing assembly 32 as represented by an arrow 52.

The hammerbank 16 with its cam follower assembly 40 is shown in greater detail in FIG. 3 together with the platen assembly 18 and a cover assembly 54. The hammerbank 16 has a plurality of hammer springs 56 mounted in generally parallel, spaced-apart relation along the length thereof. Each hammer spring 56 which is mounted on the hammerbank 16 by a screw 58 and a mounting plate 60 at a lower end of the spring has an opposite upper free end having a dot printing impact tip 62 mounted thereon. The hammer spring 56 is normally held slightly flexed in a retracted position against a pair of pole pieces 64 and 66 which are mounted within a groove 68 in the hammerbank 16 on the opposite sides of a permanent magnet 70. The hammer spring 56 is held in the retracted position against the pole pieces 64 and 66 by action of the permanent magnet 70. Magnetic flux from the permanent magnet 70 flows through the magnetic path comprised of the pole pieces 64 and 66 and the adjacent portion of the upper end of the hammer spring 56.

Each hammer spring 56, only four of which are shown in FIG. 3 for convenience of illustration, is associated with a different pair of the pole pieces 64 and 66. A different magnetic coil assembly 72 is associated with each pair of pole pieces 64 and 66 and has a pair of coils 74 and 76 respectively mounted thereon. Release of "firing" of the hammer spring 56 which is normally held in the retracted position against the pole pieces 64 and 66 by action of the permanent magnet 70 is achieved by momentarily energizing the coils 74 and 76. This causes the free upper end of the hammer spring 56 to fly forward and away from the pole pieces 64 and 66 so that the dot printing impact tip 62 extends through an associated pair of apertures in front and rear portions 78 and 80 of the cover assembly 54 mounted on the hammerbank 16. Apertures 84 in the front portion 78 of the cover assembly 82 are shown in FIG. 3. The apertures in the rear portion 80 are hidden from view in FIG. 3. As the dot printing impact tip 62 of the fired hammer spring extends through the associated apertures in the front and rear portions 78 and 80 of the cover assembly 82, a portion of a length of ink ribbon 86 is impacted against the length of print paper 25 supported against an elongated platen 90 of the platen assembly 18. The hammer spring 56 then rebounds back into the retracted position against the pole pieces 64 and 66 where the hammer spring 56 is held by action of the permanent magnet 70 in preparation for the next firing thereof.

The ink ribbon 86 which is provided by the ribbon deck 27 shown in FIG. 1 extends through the cover assembly 54 between the front and rear portions 78 and 80 thereof. The ink ribbon 86 is disposed between the apertures 84 in the front portion 78 and the corresponding apertures (not shown) in the rear portion 80 of the cover assembly 82. As the various hammer springs 56 are fired during reciprocation of the hammerbank 16 relative to the print paper 25 and the supporting platen 90, the dot printing impact tip 62 of each fired hammer spring 56 extends through the associated apertures in the cover assembly 54 to impact the ink ribbon 86 against the print paper 25.

The print paper 25 is advanced through the print station 26 defined by the interface between the cover assembly 54 and the platen 90 by the tractor drives 22 and 24 shown in FIG. 1. The tractor drives 22 and 24 engage the opposite edges of the print paper 25 in conventional fashion and have a succession of protuberances which extend through perforations 92 in the opposite edges of the print paper 25. The tractor drives 22 and 24 advance the print paper 88 upwardly in incremental fashion so that the hammerbank 16 can print a different dot row during each sweep thereof across the width of the print paper 25.

The hammerbank 16 includes an elongated shaft 94 extending along the length thereof and from the opposite ends thereof to form shaft lengths 96 and 98 at the opposite ends of the hammerbank 16. As described in detail in the previously referred to copending application Ser. No. 069,486 of Farb, the shaft lengths 96 and 98 are received by linear sleeve bearings mounted within the shuttle assembly 14. The linear sleeve bearings permit sliding motion of the shaft lengths 96 and 98 therein so that the hammerbank 16 may undergo reciprocating motion.

The cam follower assembly 40 is mounted on a tapered end 100 of the shaft length 96. The cam follower assembly 40 includes the cam follower pulley 38 rotatably mounted within a yoke 104 so as to extend outwardly from the yoke 104 and into engagement with the cam 28. The yoke 104 is coupled to a bearing assembly 106 by a collar 108 in the back of the yoke 104. The collar 108 extends through a washer 110, a coiled shuttle spring 112 and washers 114 to an end of the bearing assembly 106 surrounded by a reservoir 116 which engages a felt oil wick 118 at the end of the bearing assembly 106.

The bearing assembly 106 is mounted on the tapered end 100 of the shaft length 96. A set screw which is not shown and which is loosely confined within the collar 108 of the yoke 104 is mounted within the tapered end 100 of the shaft length 96. The set screw defines the extent to which the yoke 104 can move away from the tapered end 100 while at the same time permitting limited movement of the yoke 104 toward the tapered end 100 against the resistance of the spring 112 to absorb shocks as the roller bearing 102 follows the cam 28. At the same time the resilience of the shuttle spring 112 forces the pulley 38 against the cam 28 and maintains the pulley 38 in contact with the cam 28.

The cam follower assembly 44 of the counterbalancing assembly 32 is partly mounted within a counterbalancing mass 120 having a mass similar to that of the hammerbank 16. A spring 121 resiliently urges the cam follower pulley 42 into contact with the cam 28. The counterbalancing mass 120 is slidably mounted on a pair of shafts 122 and 124. As the cam 28 rotates, the counterbalancing mass 120 is driven back and forth in reciprocating fashion on the shafts 122 and 124 by the cam follower assembly 44.

Figure 4A:
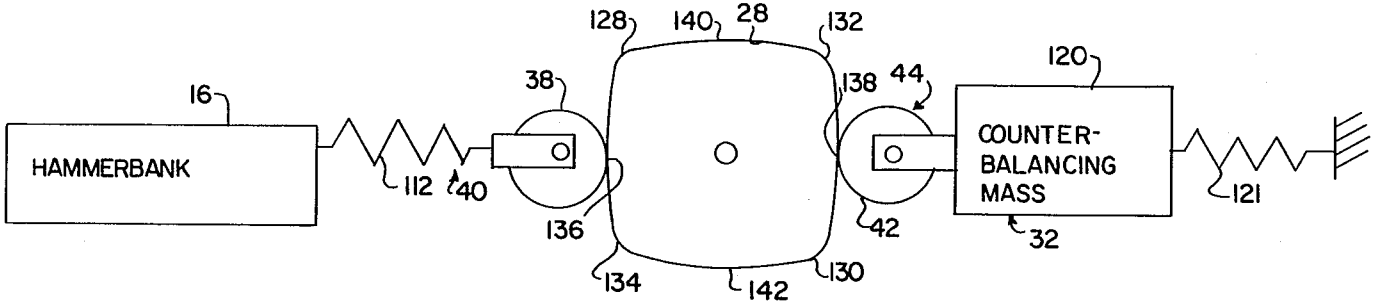
FIGS. 4A and 4B are plan views of the cam drive assembly of the printer of FIG. 1 showing the cam in two different positions.
Figure 4B:
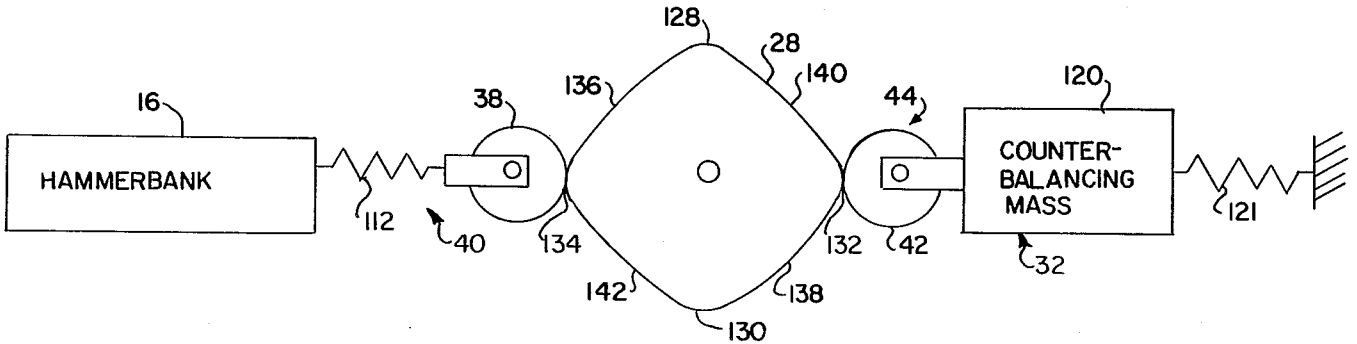

FIGS. 4A and 4B show the cam 28 in conjunction with a cam driven system 126 which is comprised of the hammerbank 16 with its cam follower assembly 40 and the counterbalancing assembly 32 including its cam follower assembly 44 and the counterbalancing mass 120. As previously noted, the cam 28 of the present example has four different lobes arranged into two opposite pairs of lobes. The lobes comprise a first pair 128 and 130 disposed opposite one another and a second pair 132 and 134 disposed opposite one another and between the lobes 128 and 130. The lobes 128, 130, 132 and 134 are equally spaced at 90° intervals around the circumference of the cam 28. In FIG. 4A, the cam follower pulley 38 contacts the cam 28 at a point 136. The opposite cam follower pulley 42 contacts the cam 28 at a point 138 opposite the point 136. The point 136 and 138 comprise low points or "valleys" midway between the peaks of the lobes 128, 130, 132 and 134. The cam 28 has another pair of opposite points 140 and 142 which are also low points or "valleys" between the peaks of the lobes 128, 130, 132 and 134. The cam 28 comes to rest in a position such as that shown in FIG. 4A in which the opposite points 136 and 138 or the opposite points 140 and 142 reside at the cam follower pulleys 38 and 42. These are points of least resistance on the cam 28. The spring 112 within the hammerbank cam follower assembly 140 is at its maximum expansion, as is the spring 121 of the counterbalancing cam follower assembly 44.

As previously noted in connection with FIG. 2, the desired direction of drive of the flywheel 30 and the attached cam 28 is clockwise as represeted by the arrow 48 in FIG. 2. Therefore, when starting to drive the cam 28 from the position shown in FIG. 4A upon startup, the cam drive motor 34 is energized to begin driving the cam 28 in the clockwise direction to move the cam follower pulley 38 up onto and then over the peak of the lobe 134 and the cam follower pulley 142 up onto and then over the peak of the lobe 132. As the cam 28 rotates in the clockwise direction from the position shown in FIG. 4A, the springs 112 and 121 are compressed until a position of maximum compression thereof is reached when the peaks of the lobes 134 and 132 are positioned at the cam follower pulleys 38 and 42. This represents the angular position or point of maximum resistance upon startup from the cam position shown in FIG. 4A. As the peaks of the lobes 134 and 132 continues past the cam follower pulleys 38 and 42, the springs 112 and 121 are able to expand until the points 142 and 140 reach the cam follower pulleys 38 and 42. Thus, the points 140 and 142 and which comprise lobe valleys define another angular position or point of least resistance.

A substantial amount of torque is required to rotate the cam 28 in a clockwise direction from the position of least resistance shown in FIG. 4A through ⅛th revolution to the position of greatest resistance shown in FIG. 4B. As the cam 28 continues to rotate beyond the position shown in FIG. 4B, considerable torque is still required, but such torque is substantially less than the torque required to achieve startup or the first ⅛th revolution of the cam 28. This is apparently due to the momentum of the system with its relatively heavy flywheel 30 and the greatly reduced frictional resistance once the system is placed in motion. The system quickly reaches a steady state condition in which a relatively small current applied to the drive motor 34 provides reciprocation of the hammerbank 16 at a desired speed.

A continuous current applied to the motor 34 to achieve startup must have an amplitude typically ten times or more the amplitude of the current required thereafter to maintain steady state operation. Consequently, the drive motor 34 must be large enough to produce the required torque for startup in response to the high current amplitude. Moreover, the high startup current amplitude requires a power supply capable of producing such current amplitudes even though only a small portion of such power supply capacity is needed thereafter to maintain steady state operation.

In accordance with the invention, the startup current requirements are reduced by an arrangement which intermittently energizes the motor 34 with current pulses in a pattern synchronous with the resonant frequency of the cam driven system 126. The cam 28 rocks back and forth in response to the current pulses until the peak resistance as represented by location of either the opposite lobes 128 and 130 or the opposite lobes 132 and 134 at the cam follower pulleys 38 and 42 is overcome. Thereafter, a continuous current is applied to the motor 34 sufficient to reciprocate the hammerbank 16 at the desired speed in steady state fashion.

Figure 5:
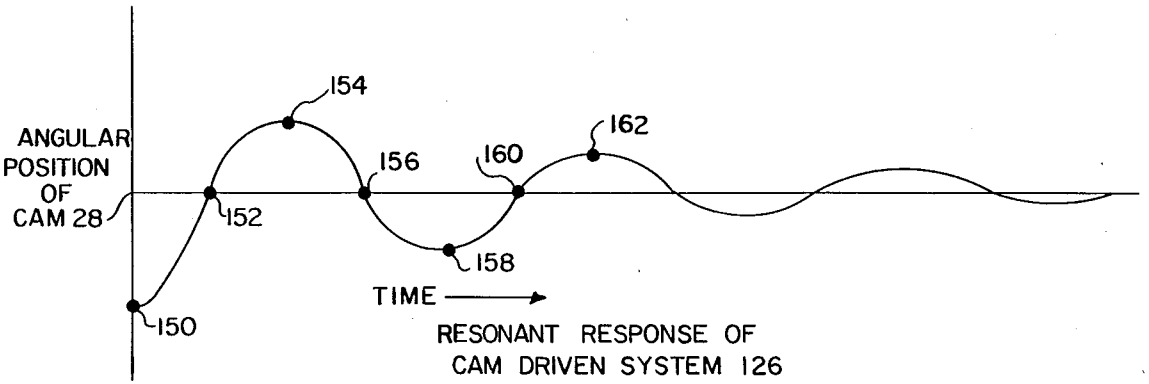
FIG. 5 is a diagrammatic plot of the angular position of the cam as a function of time showing the resonant response of the cam driven system within the printer of FIG. 1.

The resonant response of the cam driven system 126 which is comprised of the hammerbank 16 and the counterbalancing assembly 32 including the cam follower assemblies 40 and 44 thereof is easily determined and is shown in FIG. 5. FIG. 5 is a plot of angular position of the cam 28 as a function of time after the cam 28 is manually rotated to one of its angular positions of peak resistance such as the position shown in FIG. 4B and then released. At the point of release which is represented by a point 150 in FIG. 5, the cam 28 begins rotating under the urging of the shuttle springs 112 and 121. The cam 28 rotates through a point 152 representing one of the positions of least resistance such as the cam position shown in FIG. 4A to a point 154 at which the cam 28 comes to rest with the cam follower pulleys 38 and 42 most of the way up toward the peaks of one of the opposite pairs of lobes 128, 130, 132 and 134. At the point 154 the cam 28 reverses and rotates through a position of least resistance at a point 156 to a point 158 at which the cam follower pulleys 38 and 42 are part of the way up toward the peaks of the pair of the lobes 128, 130, 132 and 134 at which the cam 28 was first released. The cam 28 again reverses at the point 158 and rotates through a position of least resistance at a point 160 to a point 162 at which the cam 28 again stops and then reverses direction. The cam driven system 126 continues to oscillate in this fashion until it eventually comes to rest.

The resonant response of the cam driven system 126 shown in FIG. 5 is determined primarily by the masses of the hammerbank 16 and the counterbalancing assembly 32 and to a small extent by the spring rates of the springs 112 and 121 within the cam follower assemblies 40 and 44. The spring rates vary somewhat depending upon the extent of expansion or compression of the springs 112 and 121. For example, the spring 112 in the cam follower assembly 40 has a spring rate which varies from 0 (in.-lb./degree) at one of the cam positions of least resistance to a value of 4 (in.-lb./degree) at a point 22½° or one-sixteenth revolution removed from the position of least resistance. As the cam continues to rotate into a position of greatest resistance, the rate of the spring 112 decreases back to 0(in.-lb./degree).

The variations in the spring rates of the cam follower assemblies 40 and 44 produce minor variations in the half periods and periods of the resonant response represented by the intervals between crossings of the horizontal axis such as at the points 152, 156 and 160. The interval between the point 152 and 156 defines a half period of the resonant response and thus a half cycle of the resonant frequency defined thereby. The interval between the point 156 and the following point 160 defines a second half period and thus a second half cycle of the resonant frequency. Slight variations in the half periods occur along the response curve of FIG. 5 due to the changing spring rates of the cam follower assemblies 40 and 44 as a function of the changing positions of the cam 28 relative to the cam follower pulleys 38 and 42. Nevertheless, the resonant response is found to cross the horizontal axis at points relatively close to the equally spaced crossings of a uniform curve of constant frequency. Therefore, for purposes of the invention, the effects of changing spring rates may be ignored. It has been found in accordance with the invention that a uniform or averaged curve can be used to determine the timing and the duration of the startup current pulses. Therefore, pulsing of the motor 34 in a pattern synchronous with the average resonant frequency will produce satisfactory startup of the cam driven system.

Figure 6:
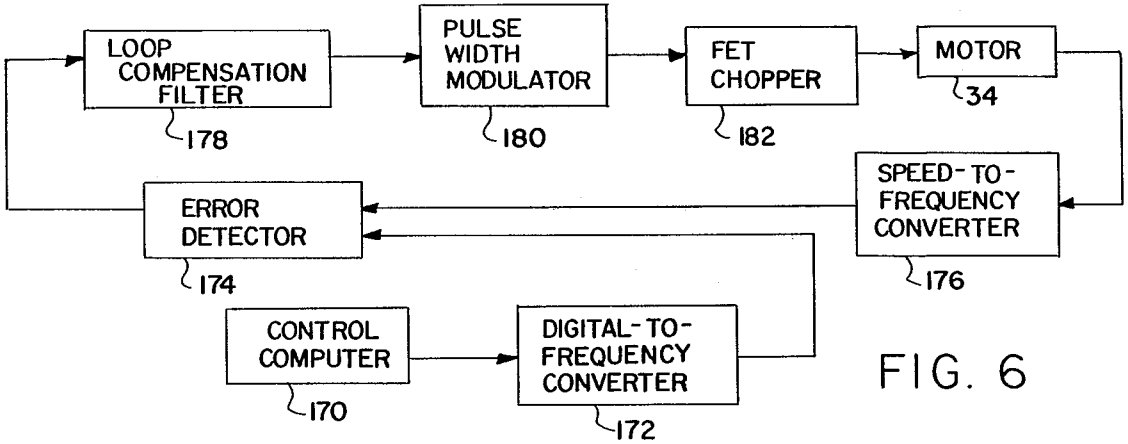
FIG. 6 is a block diagram of a servo control system for controlling the drive motor within the cam drive assembly of the printer of FIG. 1.

FIG. 6 is a block diagram of a servo control system for the motor 34. The system of FIG. 5 includes a control computer 170 for producing a command signal representing the desired speed of the motor 34. The command signal from the control computer 170 is applied to a digital-to-frequency converter 172 which converts the command signal into a square wave having a frequency corresponding to the value of the command signal and indicating the desired speed of the motor 34. The square wave from the digital-to-frequency converter 172 is applied to an error detector 174 together with the output of a speed-to-frequency converter 176.

The speed-to-frequency converter 176 is coupled to the motor 34 so as to sense the actual speed of the motor 34. The speed-to-frequency converter 176 produces a square wave the frequency of which represents the actual speed of the motor 34. The error detector 174 effectively functions as a frequency subtractor to subtract the frequency of the square wave produced by the speed-to-frequency converter 176 from the frequency of the square wave produced by the digital-to-frequency converter 172. Any difference in the frequencies results in an error voltage at the output of the error detector 174, which voltage is applied to a loop compensation filter 178.

The loop compensation filter 178 filters the error voltage from the error detector 174 to stabilize such voltage prior to applying the voltage to a pulse width modulator 180. The pulse width modulator 180 provides a high frequency voltage in response to the filtered voltage at the output of the loop compensation filter 178. The high frequency voltage is applied to a field effect transitor (FET) chopper 182 which converts the high frequency voltage into a DC current which is then applied to the motor 34. The servo control system shown in FIG. 6 results in the continuous generation of a DC current at the output of the FET chopper 182 in response to the command signal from the control computer 170 to drive the motor 34 at the desired speed during steady state operation.

Figure 7:
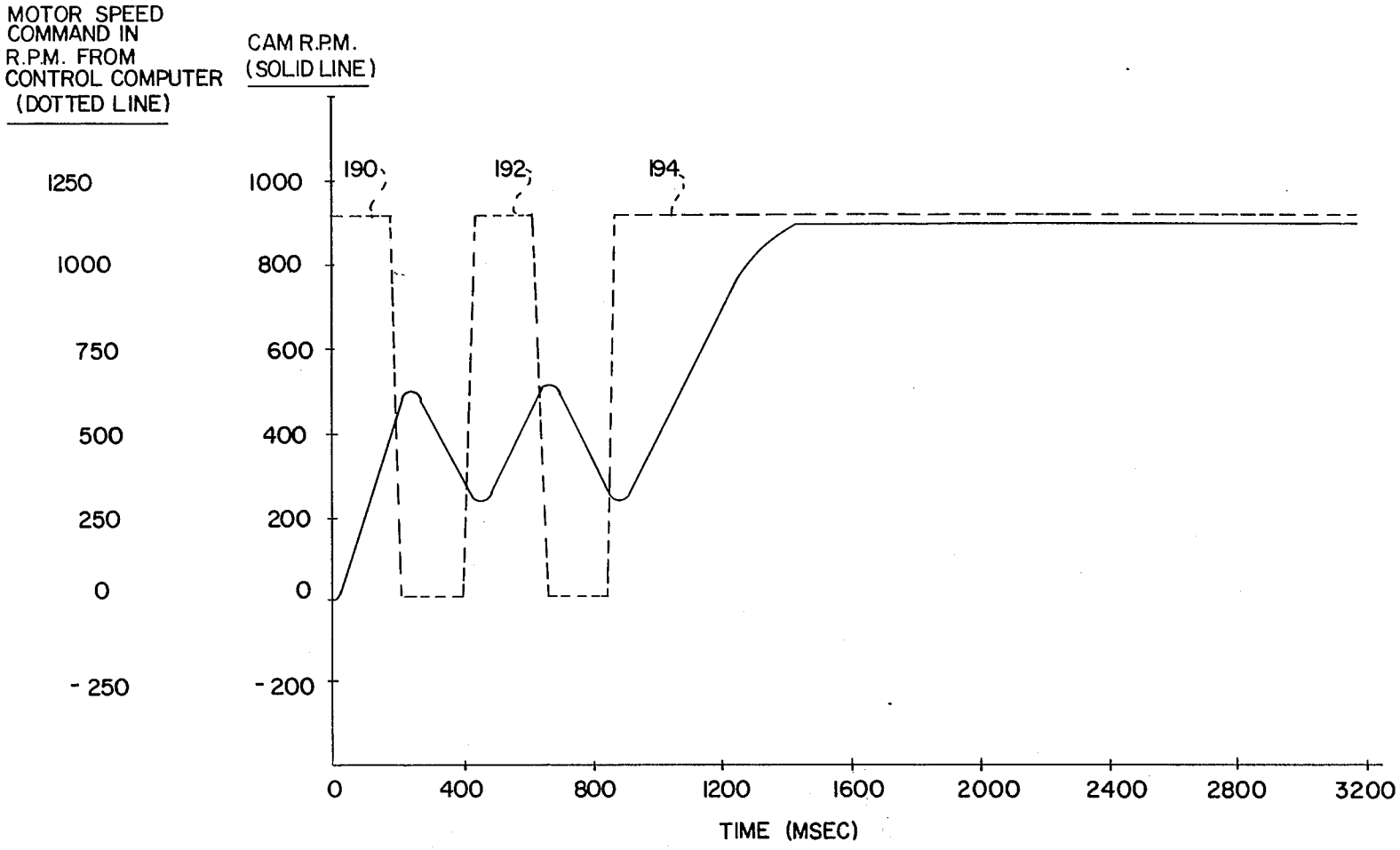
FIG. 7 is a diagrammatic plot of the motor speed command signals and the resulting cam speed as a function of time illustrating the manner in which the servo control system of FIG. 6 achieves startup in accordance with the invention.

In accordance with the invention, the control computer 170 is programmed to provide a pulsed command signal during startup so that current pulses of desired amplitude and duration are produced at the output of the FET chopper 182 for application to the motor 34. An example of this provided by FIG. 7. FIG. 7 is a plot with respect to time of startup followed by steady state operation of the cam driven system 126. Plotted with respect to time is the motor speed command in R.P.M. (revolutions per minute) from the control computer 170, which is shown in dotted outline.

Also plotted with respect to time in FIG. 7 is actual speed of the cam 28 in R.P.M., which is shown as a solid line. Because of the drive belt 36 coupling the motor 34 to the cam 28 through the flywheel 30, and because of other frictional losses, a given motor speed command results in a somewhat lower cam speed. Thus, as shown in FIG. 7 a motor speed command of 250 R.P.M. produces a cam speed of approximately 200 R.P.M. At the top of the scale a motor speed command of 1250 R.P.M. produces a cam speed of approximately 1000 R.P.M. With the understanding that such difference in speeds exists, FIG. 7 can then be viewed in terms of the motor speed command produced by the control computer 138 and the actual speed of the cam 28 that results therefrom.

In the example of FIG. 7, the average half cycle period of the resonant response shown in FIG. 5 was determined to be approximately 225 milliseconds. Based on this it was found that command signal pulses of approximately the same duration produced the desired rocking action that would accomplish startup using a considerably smaller current amplitude than was required in conventional techniques in which a continuous current is applied to the motor 34 during startup.

As shown by the dotted line in FIG. 7, a first command pulse 190 of approximately 1150 R.P.M. value was generated at the output of the control computer 170 for approximately 225 milliseconds. This produced a current pulse having an amplitude of approximately 10 amperes and a duration of approximately 225 milliseconds at the output of the FET chopper 182. As shown by the solid line in FIG. 7, the speed of the cam 28 increased from 0 to approximately 500 R.P.M. and then decreased to a value slightly greater than 200 R.P.M. in response to the first command pulse 190. This represents a first rocking of the cam 28 in the clockwise drive direction to a stopping point followed by rocking of the cam 28 in the reverse direction during a period of 450 milliseconds corresponding to an average cycle of the resonant frequency of the cam driven system 126. A second command pulse 192 of approximately 225 milliseconds duration was then produced by the control computer 170 as shown by the dotted line in FIG. 7. The corresponding portions of the solid line which represents the speed of the cam 28 illustrates a second rocking of the cam 28.

In the present example, the application of two current pulses of 10 amperes having durations of 225 milliseconds was found adequate to achieve startup if following the second pulse a continuous current is applied. Therefore, following the second command pulse 154 and the lapse of a half cycle period of 225 milliseconds thereafter, a generally continuous command pulse 194 is produced by the control computer 170. This results in the cam 28 being rocked beyond the position of greatest resistance represented by the opposite peaks of the lobes 128 and 130 or the lobes 132 and 134 so that the cam 28 continues to rotate in the clockwise direction as a steady state cam speed of approximately 900 R.P.M. is approached and thereafter maintained.

In the example of FIG. 7 the first and second command pulses 190 and 192 produce current pulses to the motor 34 having amplitudes of approximately 10 amperes. Maintaining the system in the steady state condition with a cam speed of approximately 900 R.P.M. requires a motor current of approximately 1.8 amperes. While the startup current pulse amplitudes of 10 amperes are considerably greater than the steady state current amplitude of 1.8 amperes, the advantages of the invention will be appreciated when it is considered that a continuous startup current of approximately 20 amperes was required using conventional startup techniques. The resulting halving of the required starting current amplitude resulted with the use of just two pulses prior to initiation of a continuous command signal. Had a greater number of pulses been used to effect startup, the current amplitudes produced by such pulses would be less than 10 amperes. Indeed, the required amplitude of the startup current pulses decreases with an increase in the number of pulses applied to achieve startup, such that the startup pulse current approaches the steady state motor current on a theoretical basis if enough pulses and corresponding cam rockings are utilized to produce startup. As a practical matter, however, this point is never quite reached because of frictional factors within the system.

The invention is described herein in conjunction with a cam having four lobes for purposes of illustration only. It will be appreciated by those skilled in the art that the invention is also applicable to other cam configurations including one in which the cam has just two opposite lobes and one in which the cam has a single lobe for driving the hammerbank and which may be coupled with a second cam for driving a counterbalancing assembly.

It will also be appreciated by those skilled in the art that startup in accordance with the invention can be accomplished using a closed loop system as well as the open loop system described. Printers of this type are routinely provided with position feedback means such as an encoder coupled to the cam drive system or the hammerbank for producing "fence post" pulses at a succession of different positions thereof. Such fence post pulses are representative of angular position of the cam and can be used to time the motor startup pulses and to apply a continuous motor current when it is determined that the cam has rotated past the point of peak resistance.

While there have been described above and illustrated in the drawings a number of variations, modifications and alternative forms, it will be appreciated that the scope of the invention defined by the dependent claims includes all forms comprehended thereby.

What is claimed is:

1. An arrangement for driving a hammerbank in reciprocating fashion within a printer comprising the combination of:

a slidably mounted hammerbank;

a rotatably mounted cam coupled to drive the hammerbank in reciprocating fashion;

a motor coupled to drive the cam; and a circuit coupled to energize the motor to drive the cam, the circuit comprising means for applying a succession of current pulses to the motor to accomplish startup of cam rotation followed by applying a continuous current to the motor to sustain driving of the cam to drive the hammerbank in reciprocating fashion.

2. The invention set forth in claim 1, wherein the succession of current pulses comprises a predetermined number of current pulses of predetermined amplitude and duration sufficient to move the cam past a point of peak resistance represented by engagement of the hammerbank by the peak of a lobe on the cam.

3. The invention set forth in claim 2, further including a counterbalancing assembly coupled to be driven by the cam, and wherein the current pulses are of like duration which is approximately equal to a half period of the resonant frequency of a cam driven system comprised of the hammerbank and the counterbalancing assembly.

4. The invention set forth in claim 3, wherein the hammerbank and the counterbalancing assembly each include a cam follower assembly having a compressible spring and a pulley engaging the cam.

5. In a printer, the combination comprising:

an elongated hammerbank mounted to undergo reciprocating motion and having a cam follower assembly;

a counterbalancing assembly having a cam follower assembly and disposed opposite the elongated hammerbank;

a rotatably mounted cam disposed between and engaging the cam follower assemblies of the elongated hammerbank and the counterbalancing assembly, the cam having at least one pair of opposite lobes thereon;

a motor coupled to rotatably drive the cam; and a drive circuit for the motor, the drive circuit comprising means for applying, upon startup of the printer, a succession of current pulses to the motor sufficient to move the opposite pair of lobes on the cam to and past the cam follower assemblies of the elongated hammerbank and the counterbalancing assembly and to thereafter applying a continuous current to the motor.

6. The invention set forth in claim 5, wherein the drive circuit includes means coupled to the motor for providing an indication of actual motor speed, means for providing a command signal representing desired motor speed, and means for driving the motor in accordance with the difference between the indication of actual motor speed and the command signal, the means for providing a command signal representing desired motor speed being operative to produce a succession of intermittent signals of predetermined amplitude, duration and spacing followed by a continuous signal.

7. The invention set forth in claim 6, wherein the elongated hammerbank and the counterbalancing assembly together comprise a cam driven system having a resonant response, and the intermittent signals produced by the means for providing a command signal occur in synchronism with the first half period of each cycle of the frequency of the resonant response.

8. A method of energizing a motor to rotatably drive a cam to produce reciprocating motion of a hammerbank slidably mounted within a printer and engaged by the cam, the method comprising the steps of:

applying a succession of current pulses to the motor to rock the cam back and forth until a lobe on the cam moves to and past a region of engagement of the hammerbank by the cam; and thereafter applying a continuous current to the motor to rotate the cam at a desired speed.

9. The method set forth in claim 8, comprising the further steps of determining an average resonant frequency of the reciprocating hammerbank at the cam and spacing the succession of current pulses so that the pulses occur in synchronism with the average resonant frequency.

10. The method set forth in claim 9, comprising the further step of shaping the succession of current pulses so that the duration of each current pulse is approximately equal to the period of a half cycle of the average resonant frequency.

* * * * *